United States Patent [19]

Peterson et al.

[11] 4,087,131

[45] May 2, 1978

[54] DRAG BIT EXCAVATION

[75] Inventors: Carl R. Peterson, Boxford; Allan T. Fisk, Salem, both of Mass.

[73] Assignee: Rapidex, Inc., Burlington, Mass.

[21] Appl. No.: 737,061

[22] Filed: Nov. 1, 1976

[51] Int. Cl.[2] ..... E21C 27/22; E21C 29/24

[52] U.S. Cl. ..... 299/18; 83/680; 299/57; 299/87; 299/90; 175/394

[58] Field of Search ..... 175/394, 395; 299/39, 299/78, 68, 57, 56, 23, 18; 37/81, 82; 83/672, 680

[56] References Cited

U.S. PATENT DOCUMENTS

| | | | |
|---|---|---|---|
| 2,417,313 | 3/1947 | Mackinnon | 37/81 |
| 2,920,878 | 1/1960 | Kandle | 175/394 X |
| 3,226,855 | 1/1966 | Smith | 175/394 |
| 3,827,755 | 8/1974 | Allen | 299/81 |
| 3,856,357 | 12/1974 | Wharton | 299/81 |
| 3,904,246 | 9/1975 | Gandy | 299/81 |
| 4,016,944 | 4/1977 | Wohlfeld | 175/394 X |

*Primary Examiner*—Ernest R. Purser
*Assistant Examiner*—William F. Pate, III

[57] ABSTRACT

A drag bit excavating device comprising a core extending along an axis; a bit carrier supported on the core; cutter bits supported by the carrier along a three dimensional spiral having constant pitch and increasing radius along at least a portion of the axis, the carrier being relieved to provide radially extending spaces between the turns of the spiral; a frame supporting the core, carrier, and bits for rotation about and advance along the axis; and a drive to provide rotation, whereby the bits slot the material to be excavated while the material between portions of the resulting slot extends into the spaces to be subsequently broken away.

36 Claims, 13 Drawing Figures

FIG 2
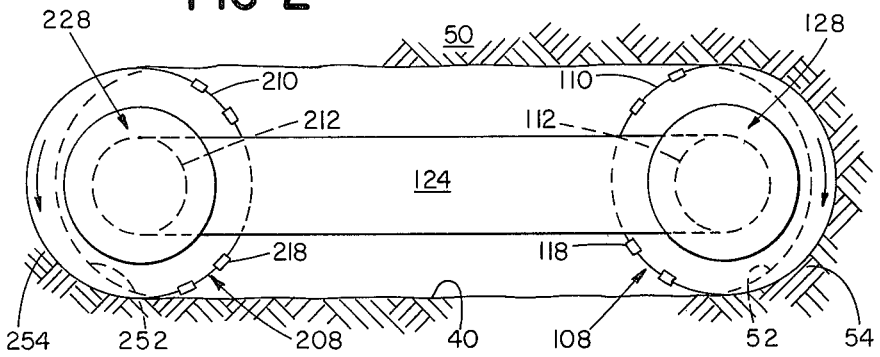
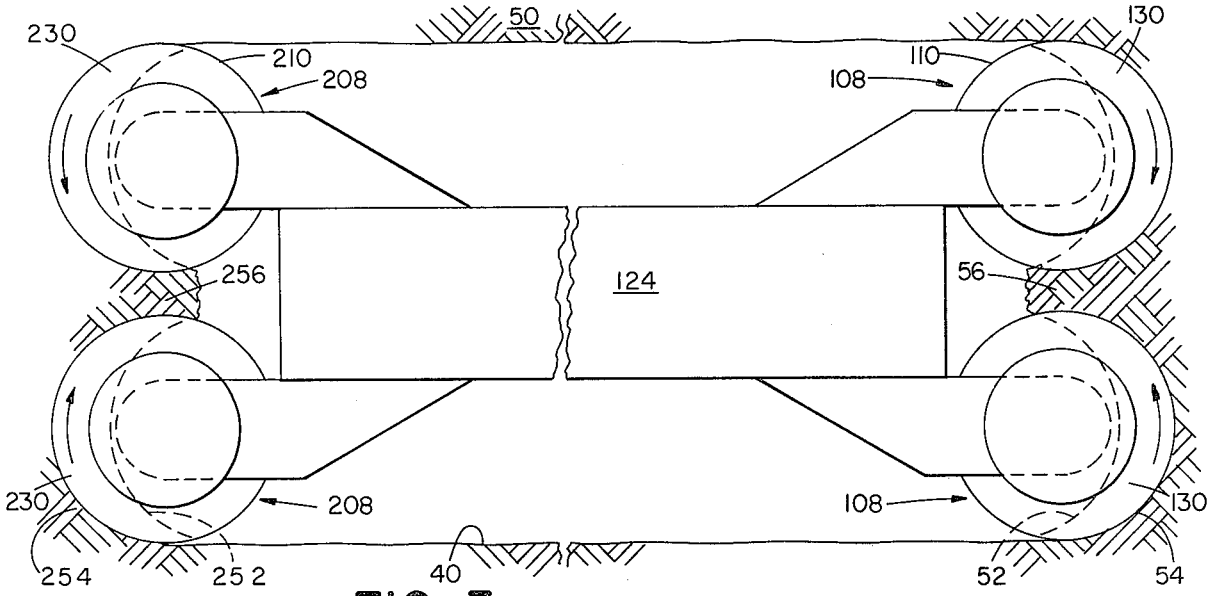
FIG 3
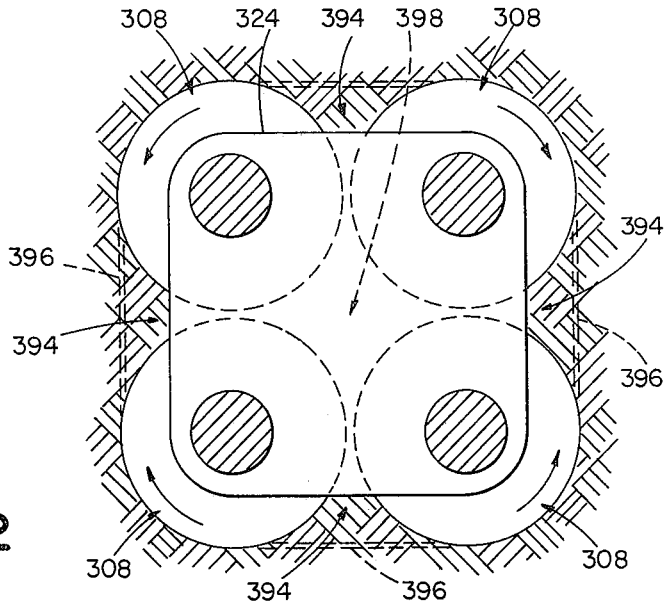
FIG 12

FIG 4
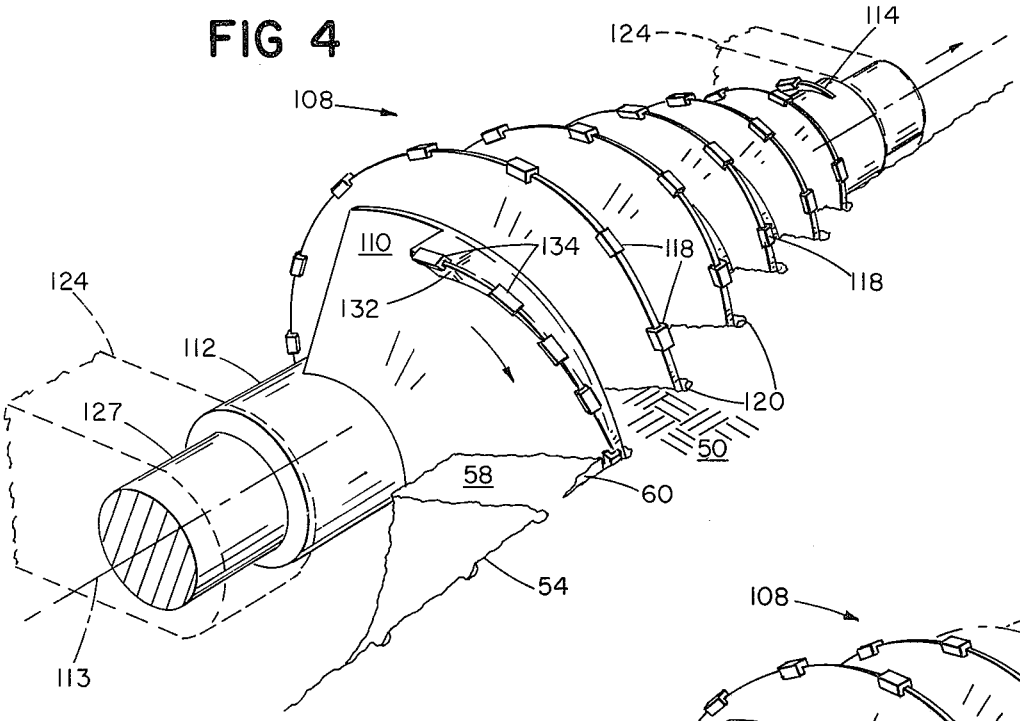
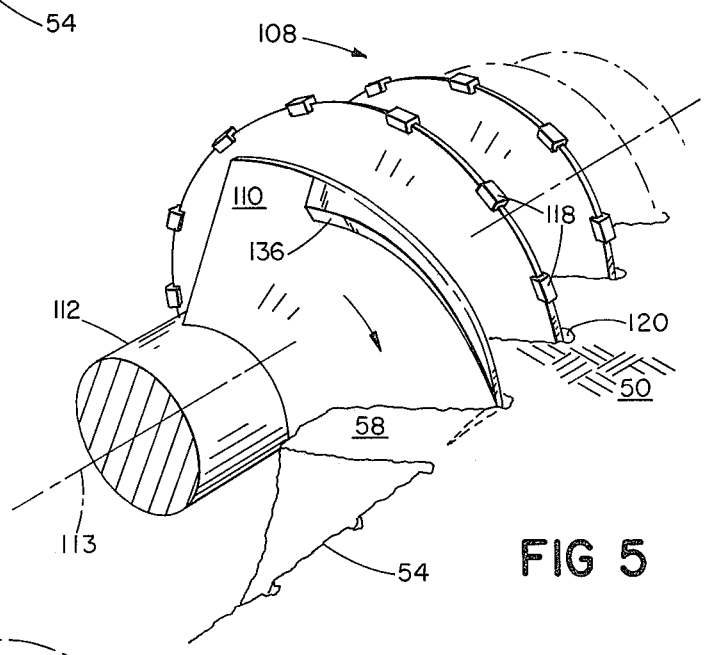
FIG 5
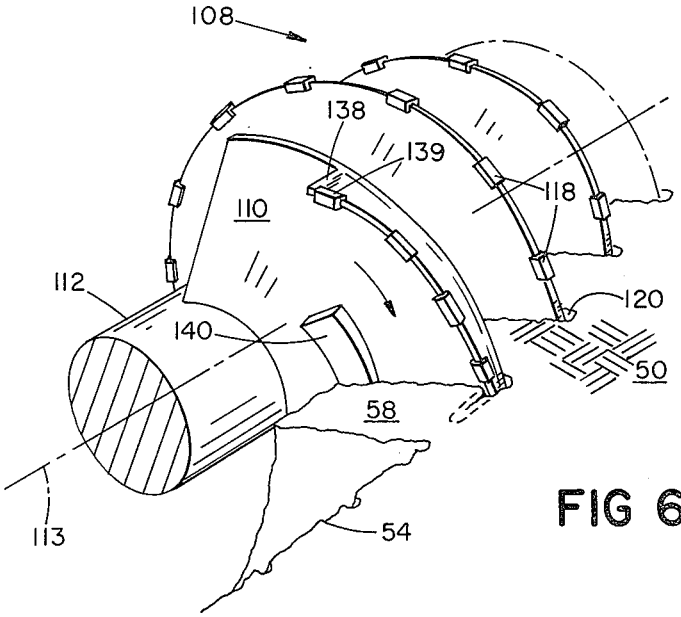
FIG 6

FIG 7
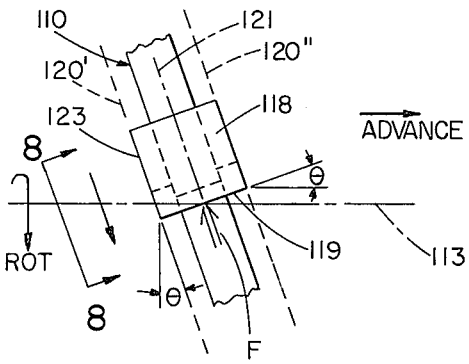
FIG 8
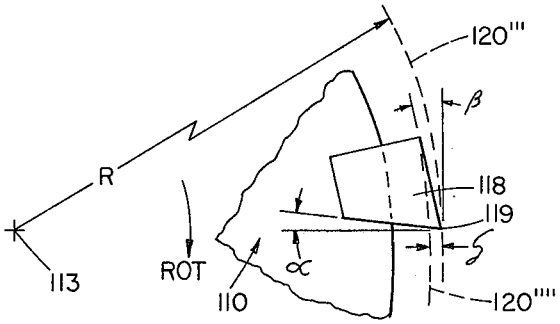
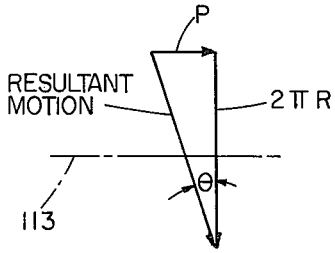
FIG 7a
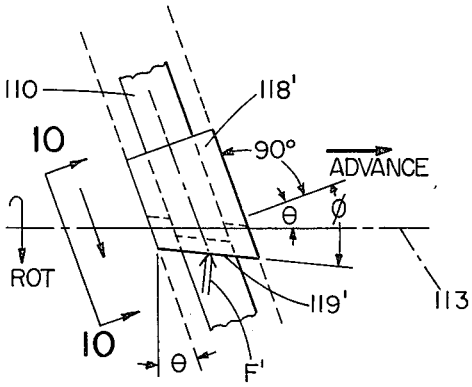
FIG 9
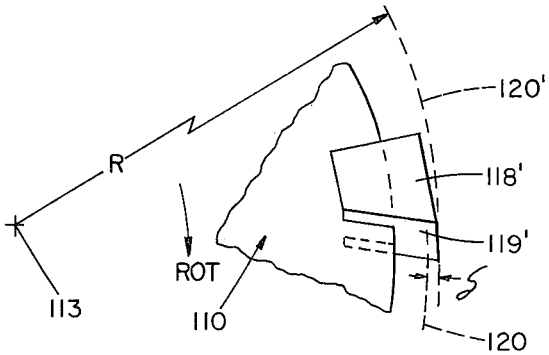
FIG 10

DRAG BIT EXCAVATION

BACKGROUND OF THE INVENTION

This invention relates to excavation with drag cutters (i.e., cutters that operate with a scraping action, like saw teeth). The invention is particularly applicable to excavation of soft to medium non-abrasive materials such as coal, potash, or trona, and even such materials as oil shale which, although of moderate compressive strength, are non-abrasive.

SUMMARY OF THE INVENTION

The invention provides for improved excavation with efficient use of power and low cutter wear. In preferred embodiments a large fraction (preferably at least ⅔) of the material being excavated is broken out in large pieces, rather than being sawed or crushed. Existing openings can be enlarged, or new openings cut. The same device can be used to repeatedly enlarge an opening on successive passes, and can even be adjusted during operation to following varying seam heights. Cutter velocity, noise, and fines generation are all low.

In general the invention features a core extending along an axis; a bit carrier supported on the core; cutter bits supported by the carrier along a three dimensional spiral having constant pitch and increasing radius along at least a portion of the axis, the carrier being relieved to provide radially extending spaces between the turns of the spiral; a frame supporting the core, carrier, and bits for rotation about and advance along the axis, and a drive to provide rotation whereby the bits slot the material to be excavated while the material between portions of the resulting slot extends into the spaces to be subsequently broken away. In preferred embodiments the bits are arranged in a single spiral; the carrier is relieved at least to a depth having a predetermined radial spacing from the axis along all said portion of the axis to permit the material to extend into the spaces to said depth all along said portion without being broken away; each bit is wider than the carrier in the direction transverse to the bit's instantaneous direction of motion in operation, to permit the carrier to extend into the slot; the carrier is relieved to the core along said axis portion, and the core is of constant cross-section along said axis portion, to permit the material to extend into the spaces to a constant depth therealong; the pitch is at least 3 times as great as the width of the bits, where the width of a bit is taken in the direction transverse to its instantaneous direction of motion in operation; the radial distance between the core and the bits at the maximum radius portion of the carrier is at least 3 times as great as the width of the bits; means are carried by the core to break away the material extending into the spaces; the means comprising in some embodiments cutting edges mounted on a continuation of the carrier to make a generally cylindrical cut transverse to the slot, and in other embodiments an arcuate wedge mounted on a continuation of the carrier; at least some of the bits having cutting edges at an angle (opening away from the direction of the advance) to a line perpendicular to the instantaneous direction of motion of the respective bit, to produce a reaction force of the material against the cutting edges having a component in the direction of the advance to propel the device along the axis, the angle preferably being greater than the mean value of the helix angles of the respective paths followed by the bits in operation; multiple cores with their respective carriers and bits are mounted in a common framework with counter-rotation to balance torque or horizontal or vertical reaction forces, the framework preferably being adjustable for varying the spacing between the cores; boring means are carried by the device forward of the bits to bore a hole in solid material to admit the core, and a system is provided for forcing flushing fluid through the core to the boring means to flush the material removed thereby; and the material extending into the spaces and broken away has at least twice the volume of the material cut by the bits to form the slots.

Other advantages and features of the invention will be apparent from the description and drawings herein of a preferred embodiment thereof.

BRIEF DESCRIPTION OF THE DRAWINGS

FIG. 2 is a rear view of an assembly of two of the elements of FIG. 1;

FIG. 3 is a rear view of an assembly of four of the elements of FIG. 1;

FIG. 4 is a perspective view of the embodiment of FIG. 1;

FIG. 5 is a fragmentary view similar to a portion of FIG. 4 but showing another embodiment;

FIG. 6 is a view similar to FIG. 5 showing yet another embodiment;

FIG. 7 is a detailed view of an individual cutter bit and the adjacent portion of the carrying web, looking radially inwardly;

Figure 11:
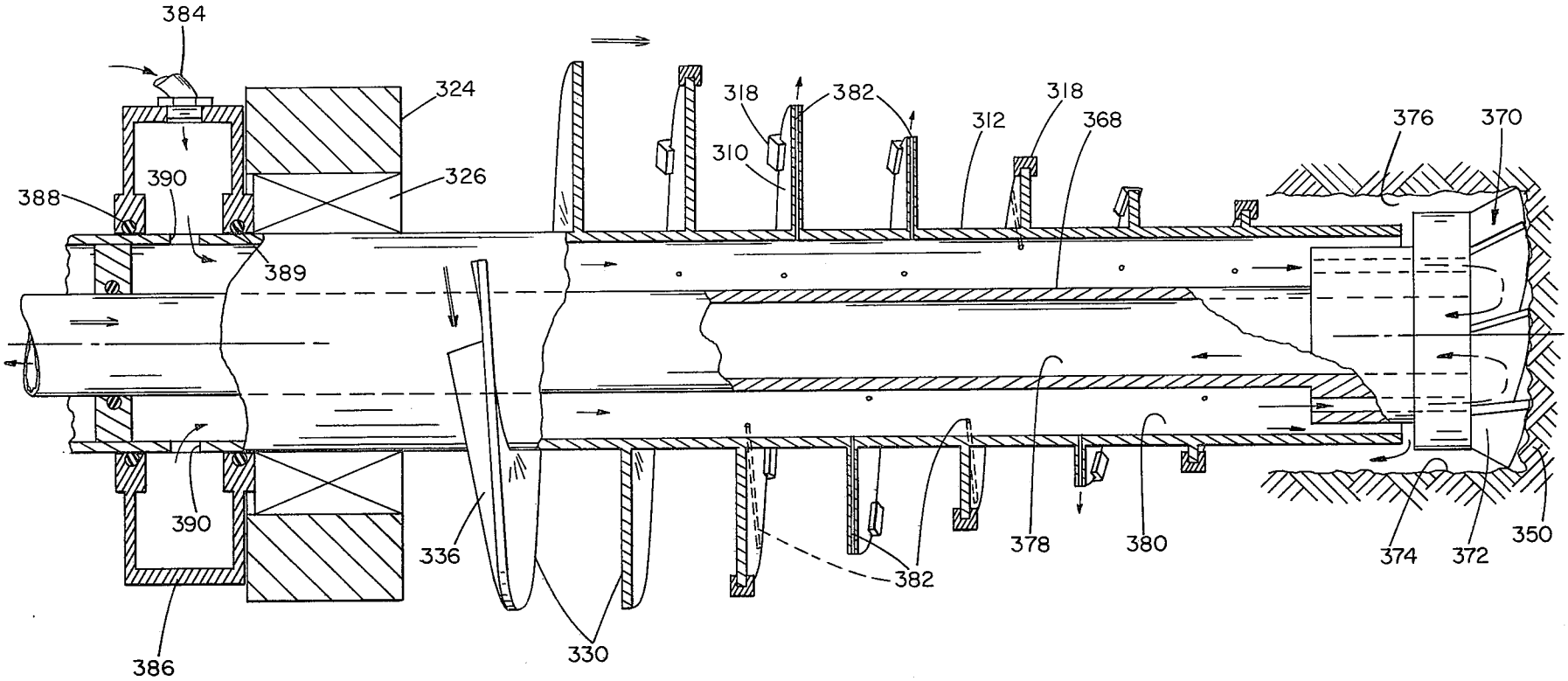

FIG. *7a* is a vector diagram illustrating instantaneous tooth motion;

FIG. 8 is a side view of the tooth of FIG. 7;

FIGS. 9–10 correspond respectively to FIGS. 7–8 and show another embodiment;

FIG. 11 is a partially-sectioned view of another embodiment of a screw element; and FIG. 12 is a rear view of an assembly of four of the elements of FIG. 11.

DESCRIPTION OF THE PREFERRED EMBODIMENT

Figure 1:
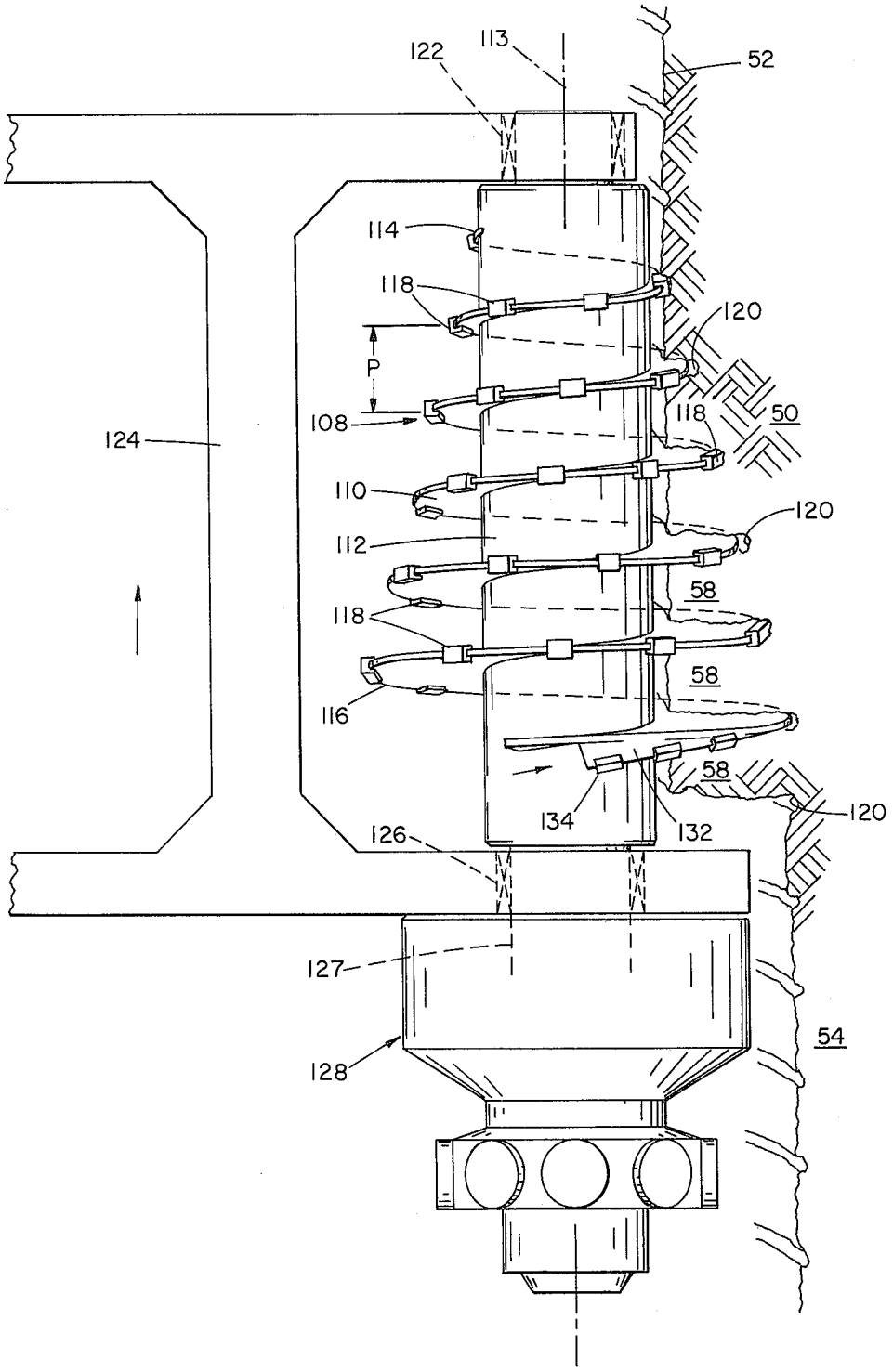
FIG. 1 is a partially schematic top view with the material being excavated shown in section.

The basic mining element is a screw-like, tapered saw as illustrated in FIG. 1. The spiral saw assembly 108 consists of a bit carrier in the form of a three-dimensional spiral web 110 of constant pitch P mounted on a central cylindrical core 112. The outer radius of web 110 increases monotonically from the leading end 114 to a maximum at 116 near the trailing end, and from that point rearward the web radius remains constant. The outer edge of web 110 is equipped with a plurality of cutter bits or teeth 118 arranged to cut into the rock 50. Teeth 118 are wider than the thickness of web 110 (in the direction transverse to the instantaneous direction of the movement of the bits in operation) and thus cut spiral slot 120, wider than web 110 in rock 50 so that upon rotation of core 112 and web 110, the latter does not rub against the sides of slot 120. In operation the assembly 108 advances parallel to core axis 113 exactly one pitch P for each revolution. As illustrated in FIG. 1, assembly 108 engages rock 50 along one side only and although slot 120 appears to be several slots, it is actually segments of a single slot, like a screw thread, which has been interrupted by the absence of rock on the opposite side of assembly 108.

Core 112 is at its forward end supported for rotation by bearing 122 in frame 124, and at its rearward end by bearing 126, also in frame 124. Rearward shaft extension 127 extends through bearing 126 to be driven by motorized drive assembly 128 (e.g., hydraulic, using fluid supplied through suitable hoses, not shown) attached to frame 124.

FIG. 2 illustrates a pair of assemblies 108, 208 mounted on frame 124. The right hand assembly 108 corresponds to that of FIG. 1, while the left hand assembly 208 is its mirror image, with 200 series numbers identifying points corresponding to those of the 100 series in 108. Note that assembly 108 rotates clockwise while assembly 208 rotates counterclockwise—the counter rotation being for the purpose of cancelling net torque on the overall assembly. This device excavates rock from both side walls of opening 40, moving original right hand wall 52 (see also FIG. 1) to 54, and left hand wall 252 to 254. Material between surfaces 52 and 54 and 252 and 254 falls to the floor to be picked up by another device (not shown).

FIG. 3 shows four rotatable assemblies of the type described above, carried on frame 124. In this device the screws on opposite sides are counter-rotated as in FIG. 2, and screws on the same side are also counter-rotated to cancel any net vertical force on the overall assembly. An uncut web or rock 56 and 256 is left between the screws on each side, to be broken off by auxiliary means (not shown). Frame 124 is adjustable to allow variation of the vertical space between the screws on each side, and hence the thickness of webs 56 and 256; thus, the overall assembly can be used to excavate to variable overall heights, e.g., for excavation of seams of various thicknesses. Variation of the width of frame 124 permits excavation of openings 40 of variable width, usually in multiple passes from an initial narrow opening to the maximum width (for mining applications) permitted by roof stability limitations.

Teeth 118 cut spaced sections of slot 120, leaving therebetween rock webs 58 which, because carrier web 110 is relieved all the way to core 112, extend into the spaces between the carrier turns all along the spiral. Cylindrical section 130 of assembly 108 is arranged to break out these "quarter moon" shaped webs. In one configuration (FIGS. 1, 4) the cylindrical extension of web 110 is equipped with a rearward extending wedge-shaped protrusion 132 which in turn is tipped with teeth 134. Upon rotation of core 112 and web 110, protrusion 132 enters slot 120, cutting and wedging rearwardly into rock web 58, with the result that a crack 60 appears, and rock web 58 breaks off, creating new rock surface 54.

FIG. 5, illustrates an alternate construction for excavating weak material such as coal: a simple wedge 136 is shown without teeth. FIG. 6 illustrates still another construction: a cylindrical (i.e., not wedge section like 132) saw 138 equipped with teeth 139 for sawing out rock web 58 and, optionally, a ramp surface 140 on web 110 to assist by bending rock web 58 to the rear.

In the devices described thus far elements have cut an interrupted thread against one side only of an existing opening—hence each cutting tooth 118 enters and leaves slot 120 once per revolution. Upon leaving slot 120, each tooth 118 thus has a chance to discharge its load of cuttings picked up in deepening slot 120.

FIG. 11 illustrates a device capable of completely excavating its own hole. Parts corresponding to those of the 100 series in FIG. 1 are numbered in the 300 series in FIG. 11. Cylindrical core 312 is hollow and carries spiral web 310 which in turn is tipped with teeth 318. The forward portion of web 310 is tapered while rearward portion 330 is cylindrical in outer diameter. Rearward web portion 330 is equipped with rearward protruding wedge 336 (see FIG. 5) to break formation left between slots to the rear. Cylindrical core 312 contains hollow shaft 368 which is connected at its leading end, and the leading end of core 312, to an auger head 370 equipped with teeth 372. Shaft 368 is rotated (by means not shown) so that head 370 can auger hole 374 in formation 350 as the assembly advances (from left to right in FIG. 11). The diameter of hole 374 is sufficient to clear cylindrical core element 312 with sufficient space to permit cuttings flow in annular spaces 376 between hole 374 and core 312. In operation core 312 and web 310 rotate (in the same or opposite direction as head 370) at a much slower speed than head 370.

One means for rearward flushing of cuttings is to force fluid (typically water) in through hole 380 in core 312 (or hole 378 in shaft 368 or both) to enter the hole through orifices (not shown) in cutter head 370. This fluid then picks up cuttings from the excavation of hole 374 and flows rearwardly in annulus 376. Cuttings produced by teeth 318 are also picked up by this rearward flow. To enhance the flushing of cuttings from teeth 318 (deep in a spiral slot 320 (not shown)) radial holes 382 in web 310, communicating with inflowing fluid inside core 312, can carry flushing fluid directly to the teeth 318.

FIG. 11 illustrates another flushing system. Fluid (water) enters from line 384 into non-rotating gland 386, around core 312. Seals 388 and 389 rotatingly seal against core 312. Fluid enters annular space 380 inside core 312 through radial ports 390. This inflow enters the region around head 370 just as before (including some radial outflow through holes 382). Some flows rearward in annulus 376, while some flows rearward through hollow shaft 368 (through bore 378).

The entire rotating assembly is carried in bearings (only one is shown) 326 in frame 324. Frame 324 is sufficiently distant from splitter 336 to avoid jamming of excavated material therebetween.

An assembly of four elements of the FIG. 11 type is shown schematically in FIG. 12. Separate elements 308 are counter-rotated as in FIG. 3, for the same reason. All four elements are mounted on a single frame 324. Unexcavated material between elements, as at 394, may be trimmed from surrounding formation by trimmer means (e.g., chain saws) shown schematically as at 396. Unexcavated material in the center 398 is unsupported and will fall to the floor easily. Note that the elements excavate all material within their circular cross-sections by augering a relatively small center portion, spirally slitting the remaining material, and breaking out the slit material to the rear. The operation of such an assembly of four elements is relatively slow, permitting ample time for rearward flushing of directly excavated (i.e., pilot hole 374 and spiral slot 320) material. For example, four elements assembled to mine a 6 by 7 foot heading in coal at 6 tons per minute would advance at about 5.6 feet per minute. Assuming a 6 inch screw pitch (a reasonable value for coal) the rotational speed of each screw element would be only 11.2 rpm. Tip speed on 3 foot diameter screws would be only 106 feet per minute—far less than typical flushing fluid velocities.

FIG. 7 shows in detail an individual cutter tooth 118 and the adjacent local portion of web 110. The instantaneous path of the tooth 118 is shown as the sides 120' and 120'' of slot 120 illustrated in previous Figures. As shown in FIG. 7*a*, a development of the motion of a single tooth 118 during one revolution of the spiral saw assembly 108 consists of a component P (the screw pitch) in the direction of the assembly axis 113, and a circumferential component equal to $2\pi R$, where R is the local radius from axis 113 to the tip of the tooth 118. The resultant motion describes a helix at angle $\theta$ with the tangential direction where $$\tan\theta = P/(2\pi R)$$

For example, for a tooth at the rear of a 2-foot radius unit having a 6-inch pitch, the helix angle would be $$\tan\theta_2 = \frac{.5}{2 \times 3.14 \times 2}$$

$$\theta_2 = 2.3°$$

For another tooth further forward on the same unit, say at a radius of 1-foot, the local helix angle would be $$\tan\theta_1 = \frac{.5}{2 \times 3.14 \times 1}$$

$$\theta_1 = 4.5°$$

Note that, whatever the local radius R, the pitch P is the same for all teeth on a given unit; hence helix angle $\theta$ varies with radius.

Returning to FIG. 7 a "square" tooth having a face 119 at 90° to the instantaneous tooth path is illustrated. FIG. 8 shows the side of tooth 118 and web 110. Line 120''' indicates the constant radius depth of groove 120 produced by this particular tooth 118 as the assembly rotates about (and advances along) axis 113. Note that the groove depth 120'''' ahead of this tooth, left by a preceding tooth at lesser radius, is less and that the illustrated tooth increases the groove 120 depth by a constant increment $\delta$, in saw-like fashion. FIG. 8 also illustrates a tooth "rake angle" $\alpha$ (which is illustrated in the conventional "positive" form but which may advantageously be "negative" for some materials) and "relief angle" $\beta$, both in keeping with conventional practice (and to avoid interference with curved surface 120'''').

The motion of the square tooth 118 in the helical direction is resisted by force F which is generated by the material (of thickness $\delta$) removed by this tooth. In general, for a square tooth as illustrated (or for any other tooth form symmetric about the tooth central plane 121), the force F will be parallel to and opposite to the direction of instantaneous motion of tooth 118. In particular, this resistive force F will have a rearward axially directed component which must be overcome by the mechanism driving the tooth 118. For the plurality of teeth 118 in contact with the rock, then, a net forward force must be provided to propel assembly 108 forward as it rotates. This force may come from an external source such as a tractive vehicle carrying the assembly, or it may arise locally as the rearward flank 123 of tooth 118 rubs against and follows the side 120' groove 120. This latter operation, however, would cause excessive wear of tooth flank 123, and it would consume excessive power.

FIG. 9 illustrates a tooth 118' having a face 119' which is skewed at angle $\phi$ (opening in the direction of advance along axis 113) relative to the "square tooth" (i.e., relative to a line perpendiclar to the instantaneous direction of tooth motion). In this case, resistance F' being at roughly 90° to face 119', has a forward component if skew angle $\phi$ is greater than the local helix angle $\theta$. Thus a skewed tooth face can be used to provide an axial propelling force component, avoiding both an external means, such as a tractive vehicle, or rubbing against the flank of the tool. Since $\theta$ varies with tooth radial position, a practical design may use a $\phi$ value that is greater than the maximum $\theta$, thus providing an excess forward force component (and resulting in rubbing on the tooth forward flank) or, preferably, a $\phi$ value that is greater than the mean $\theta$ value for all the teeth.

Preferably both pitch P and the radial distance between the cylindrical surface of core 112 and the cutting edge of tooth 118 at the maximum radius portion of web 110, are at least 3 times, and most preferably at least 5 times as great as the width of teeth 118 in the direction transverse to the instantaneous direction of tooth motion in operation. Thus, well over of the excavated material will be broken off in large chunks rather than being directly sawed by the teeth.

Other embodiments are in the following claims.

We claim:

1. A drag bit excavating device comprising
a core extending along an axis,
a bit carrier supported on said core,
cutter bits supported by said carrier along a three dimensional spiral having a constant pitch P and increasing radius along at least a portion of said axis,
said carrier being relieved to provide radially extending spaces between the turns of said spiral,
a frame supporting said core, carrier, and bits for rotation about and advance along said axis,
a drive to provide said rotation and said advance at the rate of one pitch P per revolution, and
means including said bits for cutting in the material to be excavated a slot of depth that increases with said advance, while leaving between portions of said slot and extending into said spaces, to be subsequently broken away, the major portion of said material to be excavated.

2. The device of claim 1 wherein said bits are arranged in a single said spiral.

3. The device of claim 1 wherein said carrier is relieved at least to a depth having a predetermined radial spacing from said axis along all said portion of said axis to permit said material to extend into said spaces to said depth all along said portion without being broken away.

4. The device of claim 1 wherein each bit is wider than said carrier in the direction transverse to said bit's instantaneous direction of motion in operation, to permit said carrier to extend into said slot.

5. The device of claim 1 wherein said carrier is relieved to said core along said portion of said axis.

6. The device of claim 5 wherein said core is of constant cross-section along said portion, to permit said material to extend into said spaces to a constant depth therealong.

7. The device of claim 1 wherein said pitch is at least 3 times as great as the width of said bits, where the width of a bit is taken in the direction transverse to its instantaneous direction of motion in operation.

8. The device of claim 1 wherein the radial distance between said core and said bits at the maximum radius portion of said carrier is at least 3 times as great as the width of said bits, where the width of a bit is taken in the direction transverse to its instantaneous direction of motion in operation.

9. The device of claim 1 whereby said drive provides both rotational and axial motive force.

10. The device of claim 1 further comprising means other than said bits carried by said core to break away said material extending into said spaces.

11. The device of claim 10 wherein said means comprise cutting edges mounted on a continuation of said carrier to make a generally cylindrical cut transverse to said slot.

12. The device of claim 10 wherein said means comprises an arcuate wedge mounted on a continuation of said carrier.

13. The device of claim 11 wherein said cutting edges are at a constant radius from said axis, equal to the maximum radius of said spiral.

14. The device of claim 12 wherein said wedge is at the maximum radius of said spiral.

15. The device of claim 11 wherein said cutting edges are on an arcuate wedge mounted on said carrier.

16. The device of claim 11 wherein said means further comprise a ramp mounted on said carrier radially inwardly of said cutting edges.

17. The device of claim 1 wherein said carrier is a screw-like web of constant pitch.

18. The device of claim 1 wherein at least some of said bits have cutting edges at an angle (opening away from the direction of said advance) to a line perpendicular to the instantaneous direction of motion of the respective bit, to produce a reaction force of said material against said cutting edges having a component in the direction of said advance to propel said device along said axis.

19. The device of claim 18 wherein said angle is greater than the mean value of the helix angles of the respective paths followed by said bits in operation.

20. The device of claim 1 further comprising at least one pair of said cores with their respective carriers and bits, the cores of said pair being mounted side-by-side in a common framework and arranged to rotate in opposite senses to balance torque and horizontal reaction forces on said device.

21. The device of claim 20 further comprising a first side-by-side said pair of cores, and a second such pair arranged above the first, corresponding right hand and left hand cores of the respective pairs being arranged to rotate in opposite senses to balance vertical reaction forces on said device.

22. The device of claim 1 further comprising at least one pair of said cores with their respective carriers and bits, the cores of said pair being mounted one above the other in a common framework and arranged to rotate in opposite senses to balance torque and vertical reaction forces on said device.

23. The device of claim 1 further comprising boring means carried by said device forward of said bits to bore a hole in solid material to admit said core.

24. The device of claim 23 wherein said boring means is mounted on a shaft extending through said core.

25. The device of claim 24 further comprising a system for forcing flushing fluid through said core to said boring means to flush the material removed thereby.

26. The device of claim 25 further comprising passages in said carrier to carry flushing fluid to said bits.

27. The device of claim 25 wherein said bored hole is larger in diameter than said core, to provide an annular space around said core for return of a slurry of said fluid and removed material.

28. The device of claim 25 further comprising a return conduit in said core for carrying out a slurry of said fluid and removed material.

29. The device of claim 20 wherein said framework is adjustable for varying the spacing between said cores.

30. The device of claim 22 wherein said framework is adjustable for varying the spacing between said cores.

31. A method of excavating comprising the steps of (a) providing a device comprising
- a core extending along an axis,
- a bit carrier supported on said core,
- cutter bits supported by said carrier along a three dimensional spiral having a constant pitch P and increasing radius along at least a portion of said axis, said carrier being relieved to provide radially extending spaces between the turns of said spiral,
- a frame supporting said core, carrier, and bits for rotation about and advance along said axis,
- a drive to provide said rotation and said advance at the rate of one pitch P per revolution, and
- means including said bits for cutting in the material to be excavated a slot of depth that increases with said advance, while leaving between portions of said slot and extending into said spaces, to be subsequently broken away, the major portion of said material to be excavated;

(b) advancing said device along said axis while rotating said core, carrier, and bits about said axis; and (c) breaking away said material extending into said spaces after passage through said slot of a said bit at the maximum radius of said carrier.

32. The method of claim 31 wherein said bits during said advance and rotation are maintained in contact with one surface of an existing opening being enlarged, and out of contact with the opposing surface of said opening.

33. A method of mining coal including the steps of claim 31.

34. A method of mining trona including the steps of claim 31.

35. A method of mining oil shale including the steps of claim 31.

36. The method of claim 31 wherein said material extending into said spaces and broken away has at least twice the volume of the material cut by said bits to form said slots.

* * * * *

UNITED STATES PATENT AND TRADEMARK OFFICE

CERTIFICATE OF CORRECTION

PATENT NO. : 4,087,131

DATED : May 2, 1978

INVENTOR(S) : Carl R. Peterson, Allan T. Fisk

It is certified that error appears in the above-identified patent and that said Letters Patent are hereby corrected as shown below:

Col. 5, line 66, "perpendicular" is misspelled.

Col. 6, line 17, after "over", insert --2/3--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*